US008684806B2

(12) United States Patent
Mineur et al.

(10) Patent No.: US 8,684,806 B2
(45) Date of Patent: Apr. 1, 2014

(54) GAMES BOARD WITH SQUARES WITH DIGITAL RECOGNITION AND ASSOCIATED DIGITAL PLAYING PIECE

(76) Inventors: Jean Etienne Mineur, Limoges (FR); Bertrand Duplat, Limoges (FR)

( * ) Notice: Subject to any disclaimer, the term of this patent is extended or adjusted under 35 U.S.C. 154(b) by 0 days.

(21) Appl. No.: 13/261,387

(22) PCT Filed: Jan. 12, 2011

(86) PCT No.: PCT/FR2011/000012

§ 371 (c)(1),
(2), (4) Date: Jul. 26, 2012

(87) PCT Pub. No.: WO2011/107673

PCT Pub. Date: Sep. 9, 2011

(65) Prior Publication Data

US 2013/0012312 A1 Jan. 10, 2013

(30) Foreign Application Priority Data

Mar. 4, 2010 (FR) ..... 10 00874

(51) Int. Cl.
*A63F 9/24* (2006.01)
*A63F 13/00* (2006.01)

(52) U.S. Cl.
USPC ..... 463/9; 463/36; 463/37; 345/173

(58) Field of Classification Search
USPC ..... 463/31–32; 345/173; 273/237
See application file for complete search history.

(56) References Cited

U.S. PATENT DOCUMENTS 5,717,423 A * 2/1998 Parker ..... 345/108
5,853,327 A * 12/1998 Gilboa ..... 463/39
6,102,397 A * 8/2000 Lee et al. ..... 273/238
6,443,796 B1 * 9/2002 Shackelford ..... 446/91
6,937,152 B2 * 8/2005 Small ..... 340/568.1
7,008,316 B1 * 3/2006 Pugh ..... 463/10
7,016,532 B2 * 3/2006 Boncyk et al. ..... 382/165
7,017,905 B2 * 3/2006 Lindsey ..... 273/146
7,092,747 B2 * 8/2006 Park et al. ..... 455/575.4
7,469,381 B2 * 12/2008 Ording ..... 715/702
7,753,276 B2 * 7/2010 Gelbman ..... 235/451
8,130,242 B2 * 3/2012 Cohen ..... 345/632
8,215,642 B2 * 7/2012 Macura et al. ..... 273/309
2004/0018878 A1 * 1/2004 Silverman ..... 463/46
2006/0175753 A1 * 8/2006 MacIver et al. ..... 273/237
2007/0104348 A1 * 5/2007 Cohen ..... 382/100
2008/0168404 A1 * 7/2008 Ording ..... 715/863

FOREIGN PATENT DOCUMENTS

WO WO 2008137988 A2 * 11/2008

* cited by examiner

*Primary Examiner* — Steven J Hylinski

(74) *Attorney, Agent, or Firm* — Ladas & Parry LLP

(57) ABSTRACT

The present invention therefore relates to a games board assembly comprising a series of squares, the squares representing the locations on which the individualised playing pieces of each player are restricted in terms of movement by the rules of the game, characterised in that each square on the games board comprises a digital recognition pictogram, the playing piece is a digital playing piece which incorporates a calculator, a screen interface, game software, pictogram recognition means on the board, playing piece movement calculation means on the board, a touchscreen which represents, according to the position of the digital playing piece on the games board, the characteristics of the square and/or of the updated game data field on which the digital playing piece is physically positioned.

4 Claims, 2 Drawing Sheets

GAMES BOARD WITH SQUARES WITH DIGITAL RECOGNITION AND ASSOCIATED DIGITAL PLAYING PIECE

TECHNICAL FIELD

The present invention relates to a board game and digital personalized playing piece assembly. Numerous board games are known which use games boards on which players move their personalized playing pieces. Each player has a playing piece that they move around the games board. The playing pieces move between squares on the games board as the game progresses according to the playing rules.

BACKGROUND ART

The only playing pieces currently available are inert playing pieces made of plastic, wood or composite. The playing pieces may be in the form of an object, an animal or a character. There are currently no playing pieces that incorporate digital technology, for which an interface develops as the pieces move between the game squares. Moreover, there are no playing pieces that recognise the game squares. There are currently no playing pieces in which the movements thereof are automatically measured and which calculate for themselves the game square on which they are positioned.

DISCLOSURE OF THE INVENTION

A main object of the invention is to propose for each player a digitized playing piece using digital technology and its adapted games board.

An object of the invention is to propose a playing piece that automatically recognises the squares on the games board.

An object of the invention is to propose a playing piece which incorporates a movement calculator which measures the physical movement on the squares of the games board and which, through the simple fact of the movement, automatically calculates the position of the game square on which the playing piece is positioned.

An object of the invention is to propose a playing piece which exhibits a screen interface. The screen may represent the design of the game square on which the playing piece is positioned.

An object of the invention is to propose a playing piece which exhibits a touchscreen interface allowing different playing moves to be confirmed.

An object of the invention is to propose a playing piece which exhibits a touchscreen enabling the position of the playing piece on the board to be confirmed. The image or animation of the character, object or animal represented by the playing piece in the game can thereby be represented on the screen.

An object of the invention is to propose representing the image of the board on the board too, but also on the playing piece interface.

An object of the invention is to propose a playing piece incorporating advanced functions which measure the different progress parameters in the game. These parameters may for example be points, game data fields for each player, the data fields are accessible according to the priority rules and may be defined by the player holding the playing piece but likewise optionally by other players on the board from their digital playing piece.

As a main aspect, the invention proposes a digital playing piece which incorporates a calculator, a link to a computer server, a screen interface, game representation software on the interface with the set of representation means and game functions, pictogram recognition means on the board, playing piece movement calculation means on the board. In an advanced version, the invention allows simultaneously at home on the board, but also online with players who may also be at home or elsewhere. The point scoring and storage of all game parameters may be exported to the remote server.

In one aspect the invention proposes a digital playing piece which is a latest generation mobile phone with a built-in motion sensor.

In one aspect the invention proposes a games board made up of squares with a digital recognition pictogram represented on each square.

In one aspect the invention proposes specific software which allows the player to exhibit on the playing piece precise sections of the board and/or details of the game data field.

In one aspect the invention proposes a touch interface which enables elements of the game software, the position of playing pieces in the game, game data fields to be confirmed.

In one aspect the invention proposes playing with the same playing piece with a plurality of players, the playing piece being passed from player to player according to the stage reached in the game. The interface represented on the playing piece is that defined for each personalized situation of each player.

The invention is adapted to the games board, but it may also be adapted to particular boards, such as card games or role-playing games with a complicated, multi-faceted board.

The invention may likewise use the digital playing piece as a digital die. All that is required to begin with is to open the die application, then to turn and engage a rotation of the digital playing piece, which reproduces the random effect of throwing a die.

The invention likewise allows the playing piece to be used by turning it on the edge and measuring these angular displacements in the direction of the edge. In this application, the playing piece opens up to movements on three-dimensional boards.

BRIEF DESCRIPTION OF THE DRAWINGS

The attached figures represent a particular embodiment of the invention in which.

PREFERRED MODES FOR CARRYING OUT THE INVENTION

Figure 1:
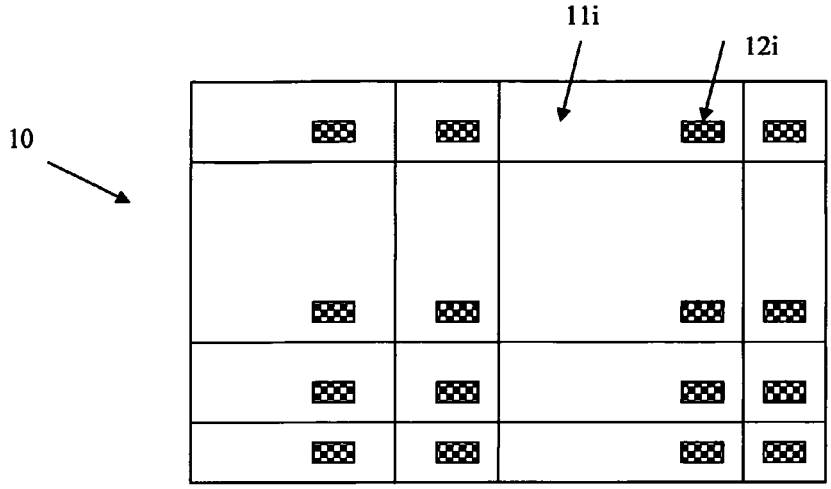
FIG. 1 represents a games board according to the invention
Figure 2:
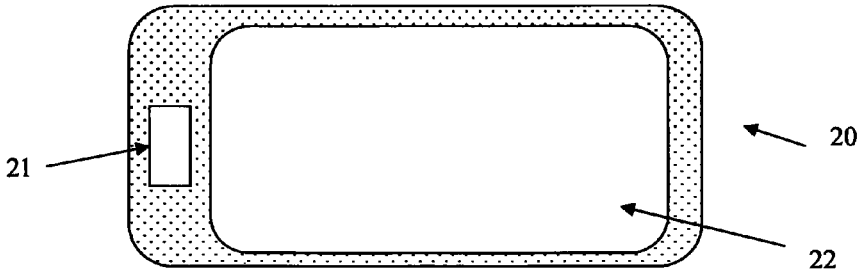
FIG. 2 represents a playing piece according to the invention
Figure 3:
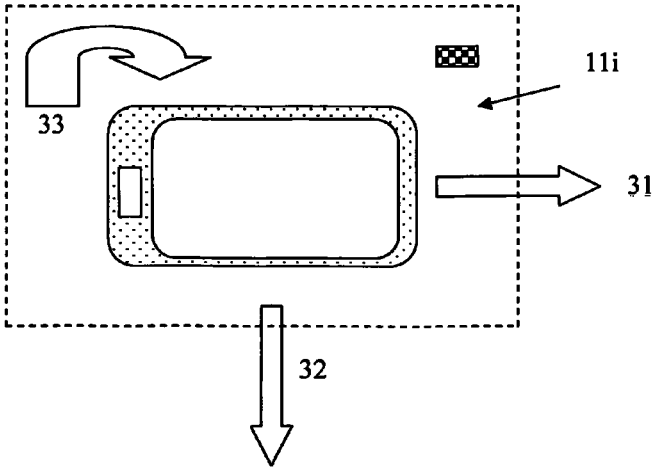
FIG. 3 represents the movement of a playing piece according to the invention
Figure 4:
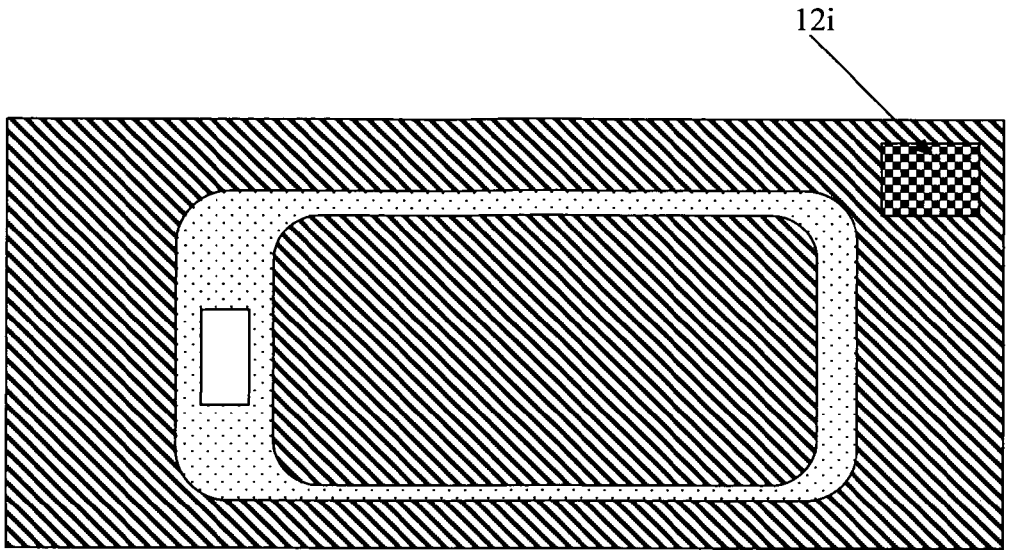
FIG. 4 represents an interactivity phase of the playing piece on a square of the board according to the invention
Figure 5:
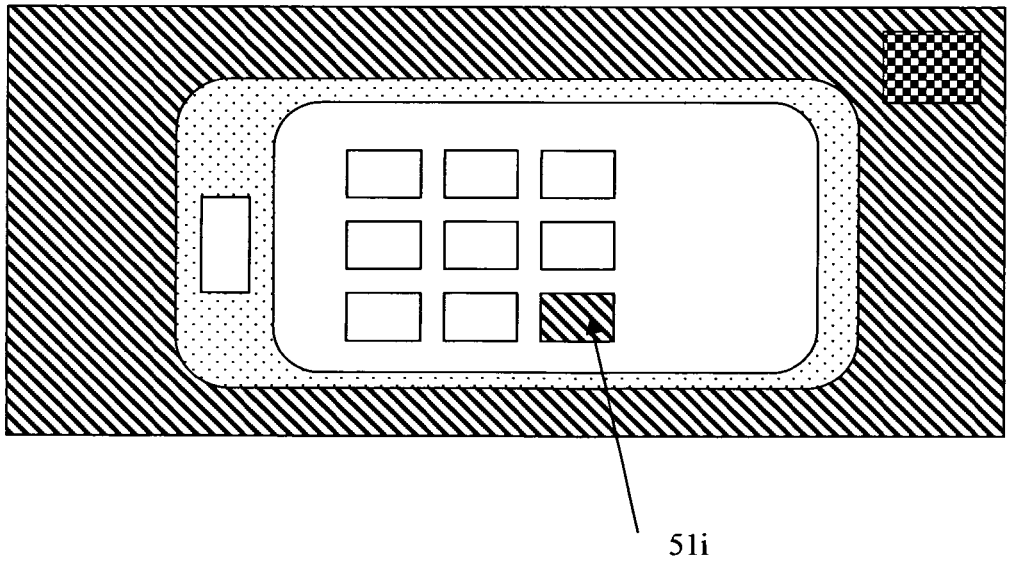
FIG. 5 represents a confirmation phase of the playing piece position on the board according to the invention.

FIG. 1 represents a games board (10) comprising a series of game squares (11*i*). The squares often form a draughtboard. They may also form any geometric shapes. The squares may even be playing cards separated from one another. Printed on each game square is a recognition pictogram (12*i*). The function of this pictogram is to be automatically recognised by the digital playing piece (20). The digital playing piece recognises the pictogram by photographing it and processing this photograph using specific integrated software. FIG. 2 represents a digital playing piece (20) according to the invention, which is a latest generation mobile phone with a built-in motion sensor. This phone is preferably an I-phone made by Apple. It exhibits a flat touchscreen (22) and a control button disposed on the casing (21). The phone is likewise controlled using the touchscreen interface by activating the specific pictograms of the computer applications represented on the screen. FIG. 3 represents the movement of a digital playing piece (20) according to the invention with transverse movements (31, 32) according to the two axes of the board surface (33). Rotation may particularly be used in a dice-throwing application. The built-in movement calculator of the digital playing piece recognises these movements and continuously calculates the position of the digital playing piece on the games board (10). If the built-in positioning calculator calculates that the digital playing piece is positioned on the game square (11*i*), it may then preferably represent on the screen interface (22) of the playing piece the design and the specific field characteristics of the square (11*i*), see FIG. 4 which represents an interactivity phase of the playing piece on a set square (11*i*) according to the invention. If the digital playing piece (20) leaves the square on which is it located to take up position on a new game square, the built-in movement calculator integrates this movement and automatically represents the new game square (11*i*+1) on which it calculates that the playing piece is located. The player may confirm this calculated positioning in two ways. One way is for him to confirm it by photographing the digital recognition pictogram (12*i*) and asking the digital playing piece to recognise this pictogram to confirm the square positioning. He may likewise confirm it directly on the screen interface (20) of his digital playing piece by pressing the square pictogram (51*i*) which represents the specific square (11*i*) on the playing interface appearing on the touchscreen (20), see FIG. 5.

The present invention therefore relates to a games board assembly (10) comprising a series of squares (11*i*), the squares (11*i*) representing the locations on which the individualized playing pieces (20) of each player are restricted in terms of movement by the rules of the game, characterized in that each square (110 on the games board (12) comprises a digital recognition pictogram (12*i*), the playing piece (20) is a digital playing piece which incorporates a calculator, a screen interface, game representation software on the screen interface, pictogram recognition means on the board, playing piece movement calculation means on the board, a casing which accommodates digital functions and makes a touchscreen (20) appear, which represents, according to the position of the digital playing piece (20) on the games board (10), the characteristics of the square (111) and/or of the updated game data field on which the digital playing piece (20) is physically positioned.

The present invention relates to a games board and digital playing piece assembly, characterized in that the position recognition of the digital playing piece (20) on the board (10) is obtained by the playing piece photographing the square recognition pictogram (12*i*).

The present invention relates to a games board and digital playing piece assembly, characterized in that the positional recognition of the digital playing piece (20) on the board (10) is obtained through integration of the calculator which measures the movement (31, 32, 33) of the playing piece on the board and automatically calculates the position thereof on the board.

The present invention relates to a games board and digital playing piece assembly, characterized in that the game software of the digital playing piece incorporates the built-in movement calculator data and gives the instruction to the screen to automatically represent the new game square (11*i*+1) on which the playing piece is located.

The present invention relates to a games board and digital playing piece assembly, characterised in that the game software of the digital playing piece enables the position of the digital playing piece to be directly confirmed on the screen interface (20) by pressing the square pictogram (51*i*) representing the specific square (11*i*) on the game interface appearing on the touchscreen (20).

It is clear that a plurality of variants possibly capable of being combined can be provided here without going beyond the framework of the invention as defined below.

We claim:

1. A game board and digital playing piece assembly comprising:

a plurality of individualized playing pieces for a plurality of players;

a game board comprising a series of squares, the squares representing the locations on which the playing pieces of each player are restricted in terms of movement by the rules of the game, wherein each square on the game board comprises a digital recognition pictogram; and wherein each playing piece is a digital playing piece which incorporates a calculator, a touch screen interface, game representation software for the screen interface, pictogram recognition means for recognizing a pictogram on the board, movement calculation means for calculating movement of the playing piece on the board, and a casing which accommodates digital functions and the touch screen interface, wherein the touch screen interface displays, according to the position of the digital playing piece on the game board, the characteristics of the square and/or of an updated game data field on which the digital playing piece is physically positioned, and wherein positional recognition of the digital playing piece on the board is obtained through integration of the calculator which measures the movement of the playing piece on the board and automatically calculates the position of the game square on which the playing piece is positioned.

2. The game board and digital playing piece assembly according to claim 1, wherein the game software of the digital playing piece incorporates the movement calculator data and gives instructions to the touch screen to automatically represent the new game square on which the playing piece is located.

3. The game board and digital playing piece assembly according to claim 2, wherein the game software of the digital playing piece enables the position of the digital playing piece to be directly confirmed on the screen interface by pressing the square pictogram representing the specific square on the game interface appearing on the touch screen.

4. The game board and digital playing piece assembly according to claim 1, wherein the digital playing piece is a mobile phone with a built-in motion sensor.

* * * * *